US008763509B1

(12) United States Patent
Nagel

(10) Patent No.: US 8,763,509 B1
(45) Date of Patent: Jul. 1, 2014

(54) FIREARM COOLING APPARATUSES AND METHODS

(71) Applicant: Wendell Nagel, Kilgore, TX (US)

(72) Inventor: Wendell Nagel, Kilgore, TX (US)

( * ) Notice: Subject to any disclaimer, the term of this patent is extended or adjusted under 35 U.S.C. 154(b) by 0 days.

(21) Appl. No.: 13/769,544

(22) Filed: Feb. 18, 2013

(51) Int. Cl.
*F41A 13/04* (2006.01)

(52) U.S. Cl.
CPC ..... *F41A 13/04* (2013.01)
USPC ..... 89/14.1; 261/152

(58) Field of Classification Search
CPC ..... F41A 13/00; F41A 13/04; F41A 13/10; F41A 13/12
USPC ..... 89/14.1; 261/152, 157
See application file for complete search history.

(56) References Cited

U.S. PATENT DOCUMENTS 1,216,939 A 2/1917 Brotherston
2,273,839 A 2/1942 DePort, et al.
3,355,571 A * 11/1967 De Kerivily ..... 219/214
5,117,734 A 6/1992 Rhoads
6,705,195 B1 3/2004 Thornton
7,594,463 B2 9/2009 Skinner
2004/0094025 A1 5/2004 Meissner et al.
2009/0049732 A1 2/2009 Kissinger
2010/0192596 A1 * 8/2010 Quisenberry et al. ..... 62/3.2

* cited by examiner

*Primary Examiner* — Stephen M Johnson
(74) *Attorney, Agent, or Firm* — R. Keith Harrison

(57) ABSTRACT

A firearm cooling apparatus includes an apparatus housing having a housing interior; at least one vent opening in the apparatus housing and communicating with the housing interior; a fan in the housing interior adjacent to the at least one vent opening; a fan motor drivingly engaging the fan; a source of electrical current disposed in electrical communication with the fan motor; a switch disposed in electrical communication with the fan motor and the source of electrical current; a tubing connector rotatably carried by the apparatus housing; and an elongated, bendable, flexible and resilient cooling tube disposed in pneumatic communication with the housing interior through the tubing connector and having an air discharge end opposite the tubing connector.

16 Claims, 8 Drawing Sheets

FIREARM COOLING APPARATUSES AND METHODS

FIELD

Illustrative embodiments of the disclosure generally relate to firearms. More particularly, illustrative embodiments of the disclosure relate to firearm cooling apparatuses and methods which facilitate significant and rapid cooling of a firearm after its use.

BACKGROUND

Firearms generate heat from the detonation of explosive charge in the chamber of the firearm to eject a projectile from a cartridge in the chamber. The typically large quantities of heat generated by firearms, particularly in their repeated use, may heat the chamber, barrel and other parts of the firearm to exceedingly high temperature. These high temperatures may cause temporary thermal expansion of the barrel and other firearm components, adversely impacting thermodynamic and structural stability and potentially compromising the accuracy of the firearm. Moreover, extreme thermal loading of firearm components may damage the components and render necessary their repair or replacement. Therefore, depending on the number of rounds which were fired from the firearm, waiting for an interval of 10-30 minutes or more may be necessary for the barrel of the firearm to return to the original starting temperature of the barrel by dissipation of heat to the ambient air.

Accordingly, firearm cooling apparatuses and methods which facilitate significant and rapid cooling of a firearm after its use may be desirable for some applications.

SUMMARY

Illustrative embodiments of the disclosure are generally directed to a firearm cooling apparatus which facilitates significant and rapid cooling of a firearm. An illustrative embodiment of the firearm cooling apparatus includes an apparatus housing having a housing interior; at least one vent opening in the apparatus housing and communicating with the housing interior; a fan in the housing interior adjacent to the at least one vent opening; a fan motor drivingly engaging the fan; a source of electrical current disposed in electrical communication with the fan motor; a switch disposed in electrical communication with the fan motor and the source of electrical current; a tubing connector rotatably carried by the apparatus housing; and an elongated, bendable, flexible and resilient cooling tube disposed in pneumatic communication with the housing interior through the tubing connector and having an air discharge end opposite the tubing connector.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "side", "end" and "interior" are used for descriptive purposes herein and indicate the relative positions of the various components of the firearms in exemplary application are not intended to be construed in a limiting sense as the firearm cooling apparatus may be used in alternative applications in which such relative terms do not apply.

Figure 1:
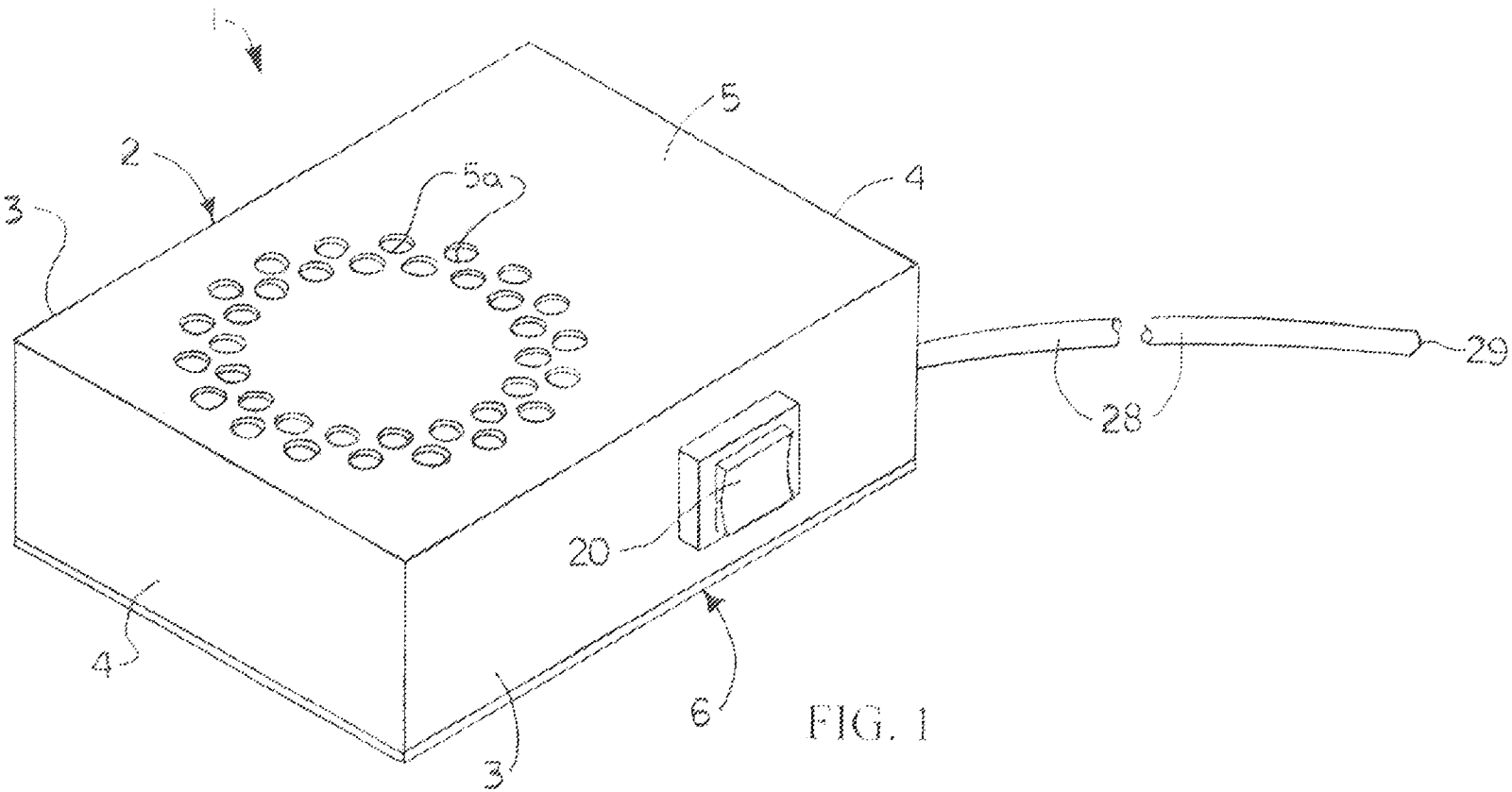
FIG. 1 is a perspective view, partially in section, of an illustrative embodiment of the firearm cooling apparatuses.
Figure 2:
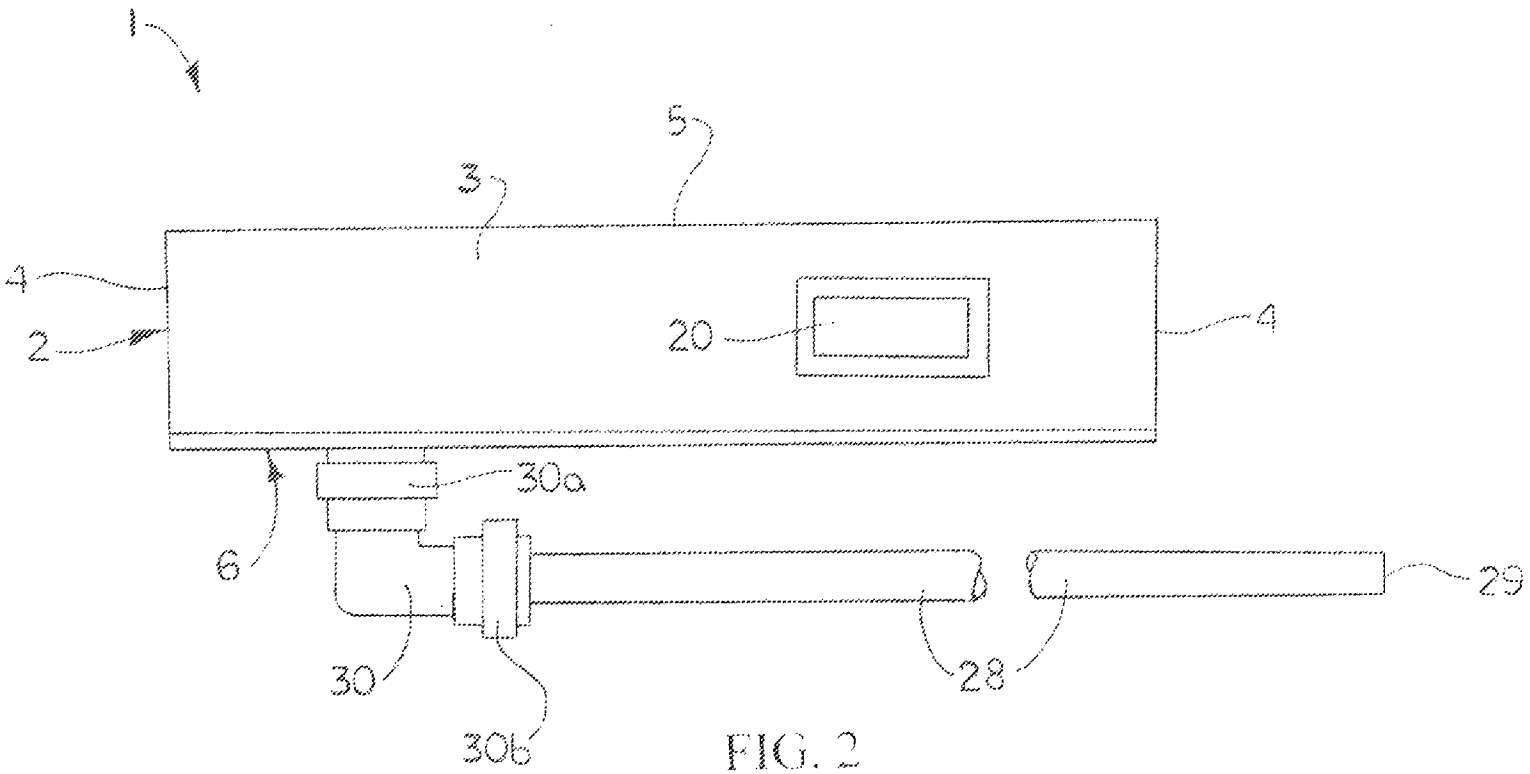
FIG. 2 is a side view, partially in section, of an illustrative embodiment of the firearm cooling apparatuses.
Figure 3:
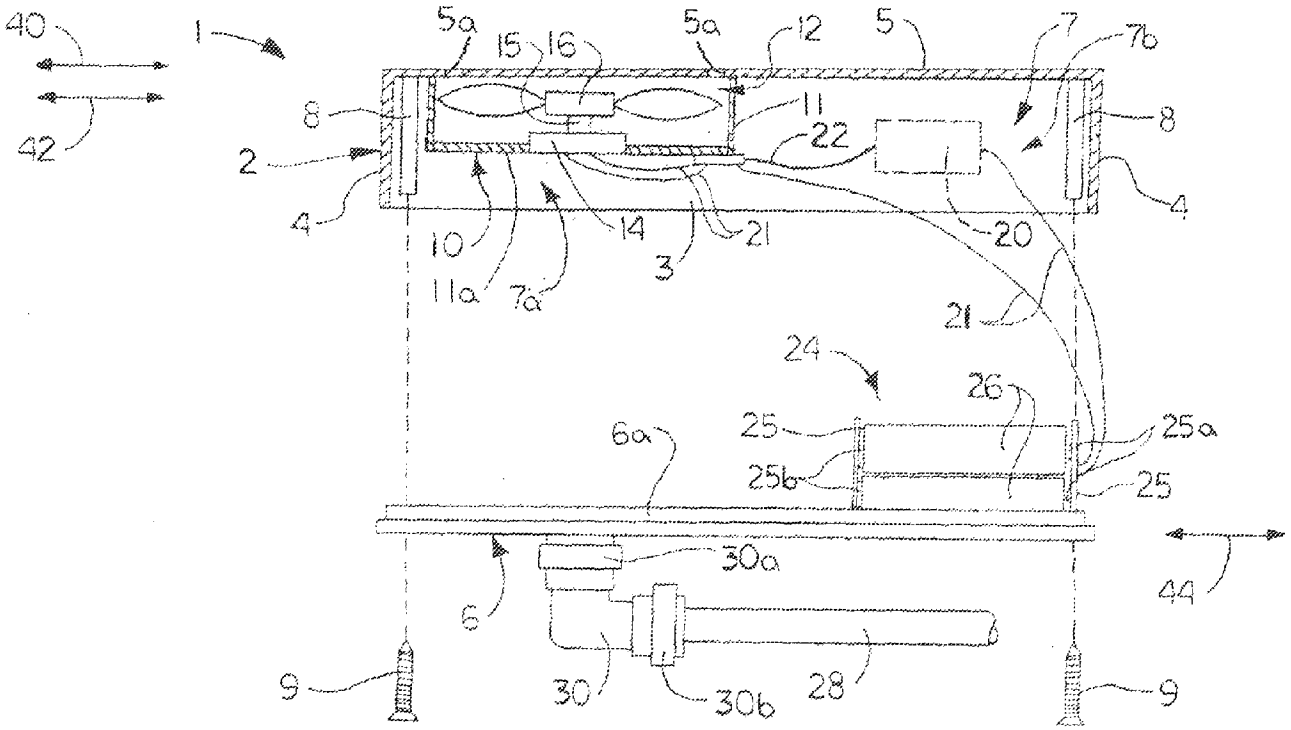
FIG. 3 is an exploded side view, partially in section, of an illustrative embodiment of the firearm cooling apparatuses.

Referring initially to FIGS. 1-4 and 5A of the drawings, an illustrative embodiment of the firearm cooling apparatuses, hereinafter apparatus, is generally indicated by reference numeral 1. The apparatus 1 includes an apparatus housing 2. In some embodiments, the apparatus housing 2 may be generally rectangular with a pair of spaced-apart, planar, parallel housing side panels 3; a pair of spaced-apart, planar, parallel housing end panels 4 extending perpendicularly between the housing side panels 3; and a planar housing vent panel 5 and a planar housing cover panel 6 on the housing side panels 3 and the housing end panels 4 and disposed in parallel and spaced-apart relationship with respect to each other. In other embodiments, the apparatus housing 2 may have alternative shapes. For example and without limitation, in various embodiments the apparatus housing 2 may be a cylindrical or a triangular, pentagonal, hexagonal or other polygonal shape. The apparatus housing 2 has a housing interior 7 (FIG. 3).

The housing cover panel 6 may be releasably attached to the apparatus housing 2 using any suitable attachment technique which is known by those skilled in the art. As illustrated in FIG. 3, in some embodiments, multiple lid fasteners 9 may attach the housing cover panel 6 to the apparatus housing 2. Multiple, interiorly-threaded fastener bosses 8 may be provided in the housing interior 7 and attached to or formed integrally with the apparatus housing 2 according to the knowledge of those skilled in the art. The lid fasteners 9 may be extended through respective fastener openings (not illustrated) in the housing cover panel 6 and threaded into the respective registering fastener bosses 8 to removably secure the housing cover panel 6 to the apparatus housing 2. As further illustrated in FIG. 3, in some embodiments, a cover panel lip 6*a* may extend from the housing cover panel 6 around the perimeter thereof for insertion into the housing interior 7 to stabilize the housing cover panel 6 on the apparatus housing 2.

At least one vent opening 5*a* may extend through the housing vent panel 5. As illustrated in FIG. 1, in some embodiments, multiple vent openings 5*a* may extend through the housing vent panel 5 in a selected number and pattern. As illustrated in FIG. 3, the vent openings 5*a* may be disposed within the plane 40 of the housing vent panel 5. A fan compartment 10 may be provided in the housing interior 7 adjacent to the vent openings 5*a*. In some embodiments, the fan compartment 10 may include a fan compartment wall 11 which may extend from an interior surface of the housing vent panel 5. Multiple fan motor support arms 11*a* may extend from the fan compartment wall 11 in parallel relationship to the plane of the housing vent panel 5 for purposes which will be hereinafter described. The fan compartment 10 has a fan compartment interior 12 which is disposed in pneumatic communication with the vent opening or openings 5*a* and with the housing interior 7 through spaces (not illustrated) between the fan motor support arms 11*a*. In some embodiments, the fan compartment 10 may be a self-contained unit which may be attached to the housing vent panel 5 and/or other element of the apparatus housing 2 via mechanical fasteners (not illustrated) and/or other suitable attachment technique known by those skilled in the art. In other embodiments, the fan compartment 10 may be fabricated in one piece with the apparatus housing 2 via molding, casting and/or other suitable techniques. The housing interior 7 may include a plenum 7*a* which is defined by and between the fan compartment 10 and the housing cover panel 6 and a battery pack compartment 7*b* which is adjacent to and disposed in pneumatic communication with the plenum 7*a*.

Figure 2A:
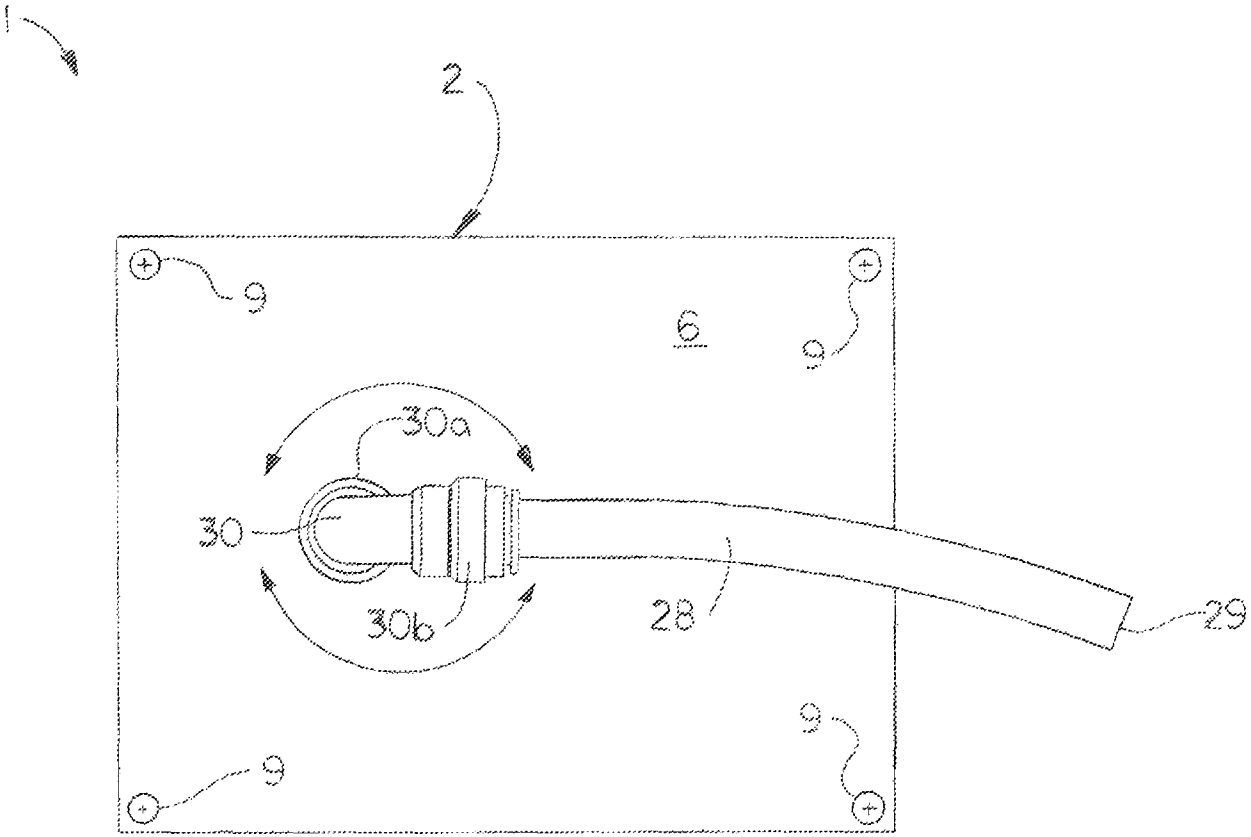
FIG. 2A is a side view of an illustrative embodiment of the firearm cooling apparatuses, more particularly illustrating a cooling tube extending from an apparatus housing of the apparatus.

A cooling tube 28 may be disposed in fluid communication with the plenum 7*a* in the housing interior 7. The cooling tube 28 may be plastic or other flexible, resilient, bendable or shapeable material. The cooling tube 28 may be pivotally connected to one of the housing side panels 3, the housing end panels 4, the housing vent panel 5 or the housing cover panel 6, as illustrated, according to the knowledge of those skilled in the art. As illustrated in FIGS. 2, 2A and 3, in some embodiments, an elbow tubing connector 30 may include a proximal connector coupling 30*a* and a distal connector coupling 30*b*. The proximal connector coupling 30*a* may be mounted for selective manual rotation relative to the housing cover panel 6, as illustrated, or other component of the apparatus housing 2 according to the knowledge of those skilled in the art. The cooling tube may be connected to the elbow tubing connector 30 via the distal connector coupling 30*b*. As illustrated in FIG. 2A, the elbow tubing connector 30 may be capable of selective manual 360-degree rotation relative to the apparatus housing 2 for purposes which will be hereinafter described. As illustrated in FIG. 3, the coupling tube 28 may be disposed in parallel relationship to the plane 44 of the housing cover panel 6 with the air discharge end 29 extending beyond the edge of the apparatus housing 2.

As further illustrated in FIG. 3, a fan motor 14 is supported by the fan motor support arms 11*a* of the fan compartment 10. The fan motor 14 drivingly engages a fan shaft 15. A fan 16 is drivingly engaged by the fan shaft 15. The fan 16 may be disposed within a plane 42 which is parallel to the plane 40 of the housing vent panel 5. As illustrated in FIG. 5A, upon selective operation of the fan motor 14, the fan shaft 15 rotates the fan 16 in the fan compartment interior 12 of the fan compartment 10. The rotating fan 16 draws ambient air 17 from outside the apparatus housing 2 through the vent openings 5*a* in the housing vent panel 5, the fan compartment interior 12, the plenum 7*a*, the tube connector 30 and the cooling tube 28, respectively. The flowing air 17 is discharged from the air discharge end 29 of the cooling tube 28.

Figure 4:
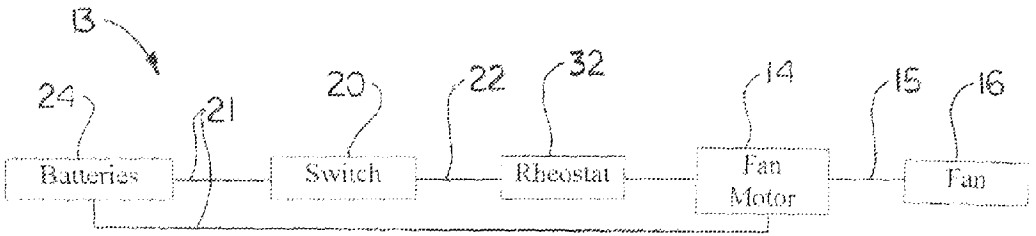
FIG. 4 is a block diagram of an exemplary apparatus control system for an illustrative embodiment of the firearm cooling apparatuses.

As further illustrated in FIGS. 3 and 4, an exemplary apparatus control system 13 for the firearm cooling apparatus 1 includes a battery pack 24 or other source of electrical current which may be electrically connected to the fan motor 14 of the fan 16 and to a fan switch 20 such as through battery pack wiring 21 or other electrical contact. The fan switch 20 is electrically connected to the fan motor 14 such as through switch wiring 22 or other electrical contact. A rheostat 32 may be electrically connected between the switch 20 and the fan motor 14. The rheostat steps down voltage from the batteries 24 to the fan motor 14. For example and without limitation, in some embodiments, the batteries 24 may provide 6 or 9 volts and the fan motor 14 may operate on 5 volts. The rheostat 32 steps down the 6 or 9 volts from the batteries 24 to the 5 volts of the fan motor 14.

As illustrated in FIG. 3, the battery pack 24 may include a pair of spaced-apart battery pack panels 25 fitted with positive electrical contacts 25*a* and negative electrical contacts 25*b* which are electrically connected to the battery pack wiring 21. Multiple batteries 26 are inserted between and disposed in electrical contact with the positive electrical contacts 25*a* and the negative electrical contacts 25*b* on the battery pack panels 25. The fan switch 20 may be provided in any suitable location on the exterior of the apparatus housing 2. As illustrated in FIG. 3, in some embodiments, the fan switch 20 may be provided on the exterior surface of one of the housing side panels 3 of the apparatus housing 2. The battery pack 24 may be provided on any structural component of the apparatus housing 2. As illustrated in FIG. 3, in some embodiments, the battery pack 24 may be provided on the interior surface of the housing cover panel 6. When the housing cover panel 6 is attached to the apparatus housing 2, the battery pack 24 is disposed inside the battery pack compartment 7*b* adjacent to the plenum 7*a*.

Figure 5:
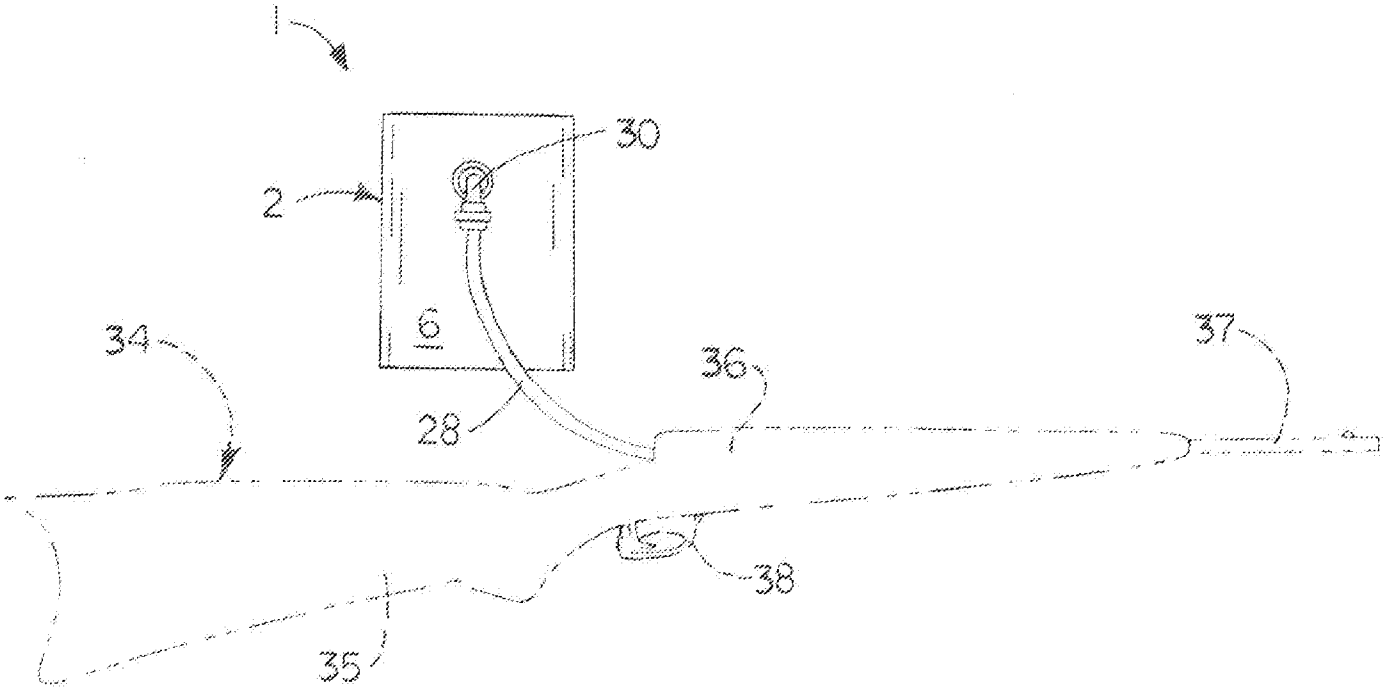
FIG. 5 is a side view (illustrated in phantom) of a firearm, more particularly illustrating cooling of a chamber of the firearm in exemplary implementation of an illustrative embodiment of the firearm cooling apparatuses.
Figure 5A:
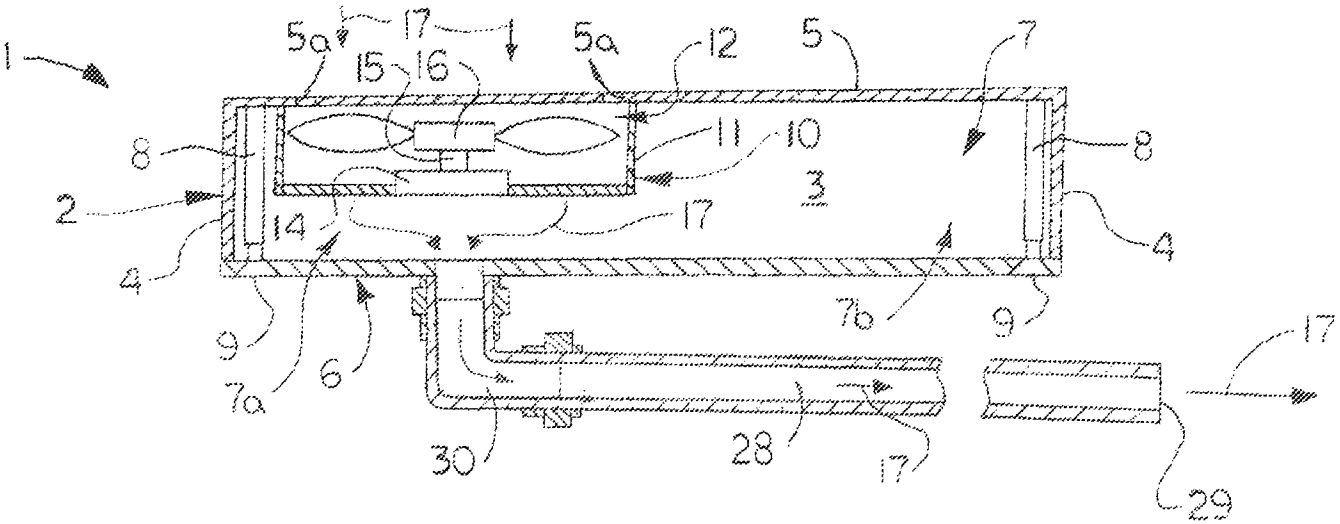
FIG. 5A is a longitudinal sectional view of an illustrative embodiment of the firearm cooling apparatuses, with the battery pack omitted for clarity, more particularly illustrating flow of air through the apparatus in exemplary application thereof.
Figure 6:
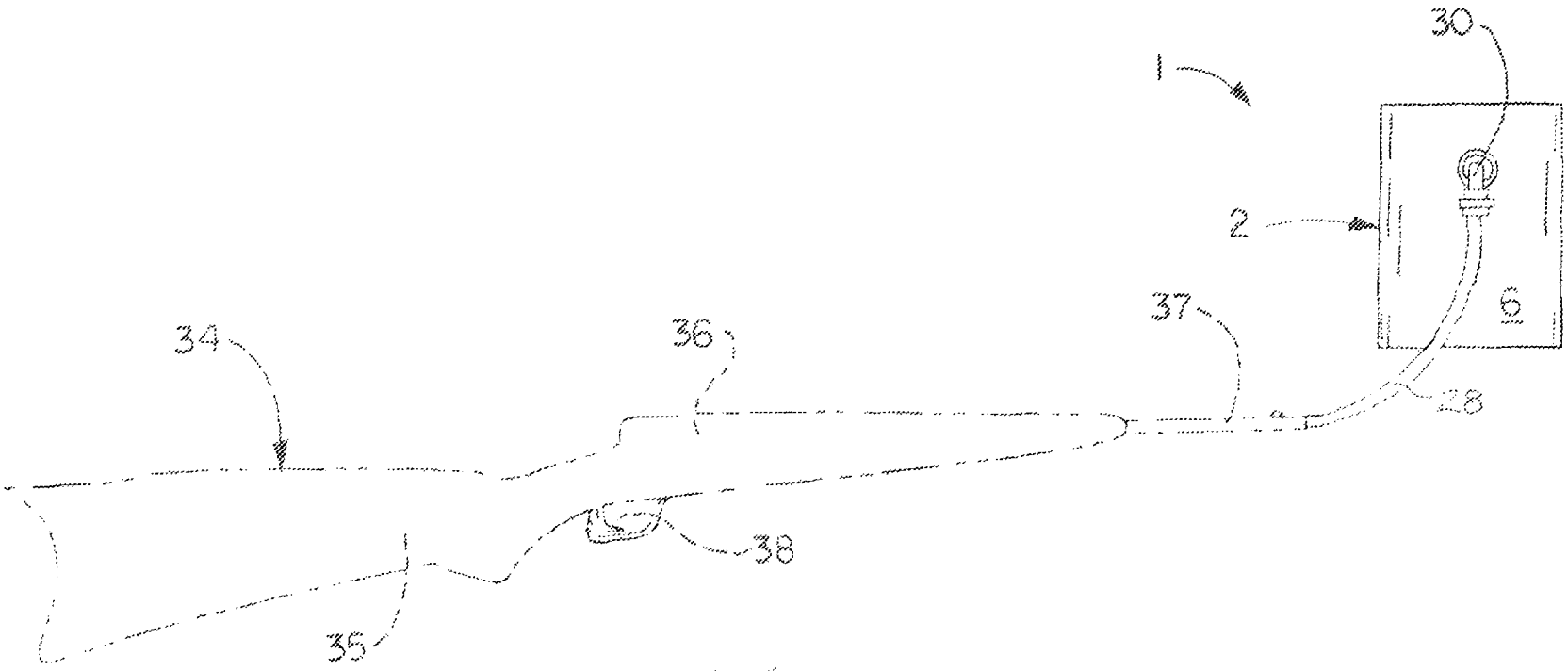
FIG. 6 is a side view (illustrated in phantom) of a firearm, more particularly illustrating cooling of a barrel of the firearm in exemplary implementation of an illustrative embodiment of the firearm cooling apparatuses.

Referring next to FIGS. 5, 5A and 6 of the drawings, in exemplary application, the apparatus 1 is used to significantly and rapidly cool a firearm 34 after use of the firearm 34. The firearm 34 may be a single-shot firearm, a semiautomatic firearm, an automatic firearm or a revolver, for example and without limitation. Generally, the firearm 34 may include a stock 35; a chamber 36 which is at the fore end of the stock 35 and is adapted to receive at least one cartridge (not illustrated); a barrel 37 extending forwardly from the chamber 36; and a finger-actuated trigger 38 witch actuates detonation of an explosive charge in and firing of a projectile (not illustrated) from the cartridge in the chamber 36 through the barrel 37. Due to the detonation of the explosive charge which discharges the projectile from the cartridge in the chamber 36, large quantities of heat may be generated in the chamber 36, the barrel 37 and other parts of the firearm 34, particularly in repeated firing of the firearm 34.

As illustrated in FIG. 5, in some applications, the chamber 36, the barrel 37 and other components of the previously-fired firearm 34 may be cooled by inserting the air discharge end 29 of the cooling tube 28 into the chamber 36. The switch 20 of the apparatus 1 is manipulated from the OFF position to the ON position to operate the fan motor 14 (FIG. 5A). Accordingly, as further illustrated in FIG. 5A, the fan motor 14 rotates the fan 16, which draws ambient air 17 through the vent openings 5*a* in the housing vent panel 5 into and through the fan compartment interior 12 of the fan compartment 10, the plenum 7*a* in the housing interior 17, the elbow tubing connector 30 and the cooling tube 28, respectively. The air 17 is discharged from the air discharge end 29 of the cooling tube 28 and flows into and through the chamber 36 and the barrel 37, respectively, and is discharged from the barrel 37 of the firearm 34. Accordingly, the air 17 significantly and quickly cools the chamber 36, the barrel 37 and other components and parts of the firearm 34 such that the chamber 36 can be quickly reloaded and fired again without having to wait for the firearm 34 to gradually cool by the usual contact with ambient air which surrounds the firearm 34. Therefore, the apparatus 1 significantly reduces the cooling time of the firearm 34 for continued use of the firearm 34 (typically about 2-10 minutes for the barrel of the firearm to return to the original starting temperature of the barrel by dissipation of heat to the ambient air depending on the number of rounds which were fired from the firearm) in order to prevent overheating and the risk of damage to and aiming inaccuracies of the firearm 34 which may otherwise occur.

As illustrated FIG. 6, in an alternative application of the apparatus 1, the chamber 36, the barrel 37 and other components of the firearm 34 may be cooled by inserting the air discharge end 29 of the cooling tube 28 into the open end of the barrel 37. The air 17 is discharged from the air discharge end 29 of the cooling tube 28 and flows into and through the barrel 37 and the chamber 36, respectively, and is discharged from the chamber 36 of the firearm 34. The flowing air 17 cools the barrel 37 and the chamber 36 to reduce the cooling time of the firearm 34 between uses thereof as was heretofore described. This practice, however, may be unsafe as the user of the firearm 34 may inadvertently forget that the cooling tube 28 of the apparatus 1 is inserted in the barrel 37 of the firearm 34 upon use of the firearm 34.

It will be appreciated by those skilled in the art that the arrangement or distribution of the vent openings 5*a* within the plane 40 (FIG. 3) of the housing vent panel 5 and the orientation of the fan 16 within the plane 42 parallel to the plane 40 ensures that a sufficient quantity of ambient air 17 flows through and is discharged from the cooling tube 28 to cool the firearm 34. Moreover, some of the flowing ambient air 17 may flow into the battery pack compartment 7*b* to cool the battery pack 24. It will be further appreciated by those skilled in the art that the flexibility or bendability of the cooling tube 28, with the 360-degree rotational capability of the elbow tubing connector 30 relative to the apparatus housing 2, enables the apparatus housing 2 to be located at any position relative to the chamber 36 or the barrel 37 of the firearm 34 for placement of the air discharge end 29 of the cooling tube 28 for cooling of the firearm 34.

Figure 7:
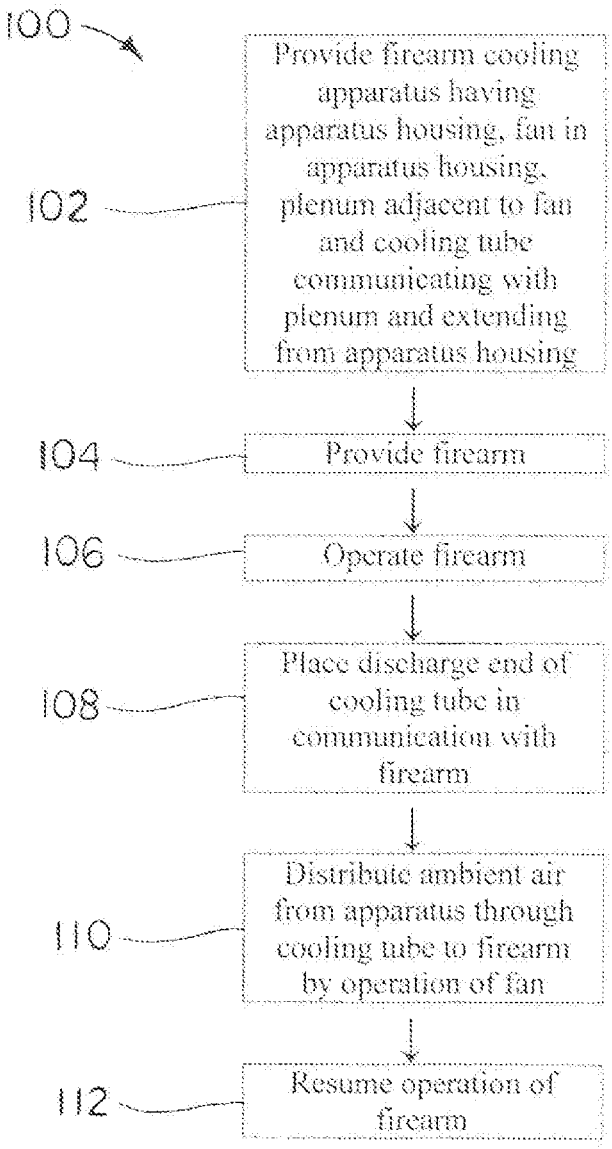
FIG. 7 is a block diagram of an illustrative embodiment of the firearm cooling methods.

Referring next to FIG. 7 of the drawings, an illustrative embodiment of a firearm cooling method is generally indicated by reference numeral 100. In block 102, a firearm cooling apparatus is provided. The firearm cooling apparatus includes an apparatus housing, a fan in the apparatus housing, a plenum adjacent to the fan and a cooling tube communicating with the plenum and extending from the apparatus housing. In block 104, a firearm is provided. In block 106, the firearm is operated. In block 108, after operation of the firearm, a air discharge end of the cooling tube of the firearm cooling apparatus is placed in pneumatic communication with the firearm. In some applications, the air discharge end of the cooling tube may be placed in pneumatic communication with the chamber of the firearm. In other applications, the air discharge end of the cooling tube may be placed in pneumatic communication with the barrel of the firearm. In still other implications, the air discharge end of the cooling tube may be placed in pneumatic communication with some other portion or surface of the firearm. In block 110, ambient air is distributed from the apparatus through the cooling tube and is discharged into the firearm by operation of the fan in the apparatus housing of the apparatus. The flowing air dissipates heat from the chamber, the barrel and other components and cools the firearm. In block 112, operation of the firearm may be resumed.

While illustrative embodiments of the disclosure have been described above, it will be recognized and understood that various modifications can be made and the appended claims are intended to cover all such modifications which may fall within the spirit and scope of the disclosure.

What is claimed is:

1. A firearm cooling apparatus, comprising:

a generally rectangular apparatus housing having a housing interior, the apparatus housing including a pair of spaced-apart, planar, parallel housing side panels; a pair of spaced-apart, planar, parallel housing end panels extending perpendicularly between the housing side panels; and a planar housing vent panel and a planar housing cover panel on the housing side panels and the housing end panels and disposed in parallel and spaced-apart relationship with respect to each other;

at least one vent opening in the apparatus housing and communicating with the housing interior;

a fan in the housing interior adjacent to the at least one vent opening;

a fan motor drivingly engaging the fan;

a plenum disposed between the fan and the housing cover panel;

a source of electrical current disposed in electrical communication with the fan motor, the source of electrical current including a battery pack disposed in the housing interior adjacent to the plenum;

a switch disposed in electrical communication with the fan motor and the source of electrical current;

a tubing connector rotatably carried by the apparatus housing; and an elongated, bendable, flexible and resilient cooling tube disposed in pneumatic communication with the housing interior through the tubing connector and having an air discharge end opposite the tubing connector.

2. The firearm cooling apparatus of claim 1 wherein the at least one vent opening comprises a plurality of vent opening in the housing vent panel and disposed within a plane of the housing vent panel.

3. The firearm cooling apparatus of claim 1 wherein the battery pack comprises a pair of spaced-apart battery pack panels; a pair of electrical contacts on the battery pack panels, respectively, the electrical contacts disposed in electrical communication with the fan motor and the switch; and a plurality of batteries extending between and in electrical contact with the electrical contacts.

4. The firearm cooling apparatus of claim 1 wherein the tubing connector comprises an elbow tubing connector.

5. A firearm cooling apparatus, comprising:

an apparatus housing having a housing interior;

at least one vent opening in the apparatus housing and communicating with the housing interior;

a fan in the housing interior adjacent to the at least one vent opening;

a fan motor drivingly engaging the fan;

a plenum in the housing interior adjacent to the fan;

a battery pack compartment in the housing interior adjacent to the plenum;

a battery pack in the battery pack compartment and disposed in electrical communication with the fan motor;

a switch carried by the apparatus housing and disposed in electrical communication with the fan motor and the battery pack;

an elbow tubing connector rotatably carried by the apparatus housing; and an elongated, bendable, flexible and resilient cooling tube disposed in pneumatic communication with the housing interior through the tubing connector and having an air discharge end opposite the elbow tubing connector.

6. The firearm cooling apparatus of claim 5 wherein the apparatus housing is generally rectangular.

7. The firearm cooling apparatus of claim 6 wherein the apparatus housing comprises a pair of spaced-apart, planar, parallel housing side panels; a pair of spaced-apart, planar, parallel housing end panels extending perpendicularly between the housing side panels; and a planar housing vent panel and a planar housing cover panel on the housing side panels and the housing end panels and disposed in parallel and spaced-apart relationship with respect to each other.

8. The firearm cooling apparatus of claim 7 wherein the at least one vent opening comprises a plurality of vent openings in the housing vent panel and disposed within a plane of the housing vent panel.

9. The firearm cooling apparatus of claim 7 wherein the elbow tubing connector is rotatably carried by the housing cover panel.

10. The firearm cooling apparatus of claim 7 wherein the battery pack is carried by the housing cover panel.

11. The firearm cooling apparatus of claim 7 wherein the plenum is disposed between the fan and the housing cover panel of the apparatus housing.

12. The firearm cooling apparatus of claim 5 wherein the battery pack compartment is disposed in pneumatic communication with the plenum.

13. A firearm cooling apparatus, comprising:

an apparatus housing including:

a pair of spaced-apart, planar, parallel housing side panels;

a pair of spaced-apart, planar, parallel housing end panels extending perpendicularly between the housing side panels;

a planar housing vent panel carried by the housing side panels and the housing end panels;

a planar housing cover panel carried by the housing side panels and the housing end panels and disposed in parallel and spaced-apart relationship with respect to the housing vent panel; and a housing interior;

a plurality of vent opening in the vent panel, the plurality of vent openings disposed within a plane of the vent panel and communicating with the housing interior;

a fan in the housing interior adjacent to the plurality of vent openings, the fan disposed within a plane parallel to the plane of the vent panel;

a fan motor drivingly engaging the fan;

a plenum in the housing interior between the fan and the housing cover panel of the apparatus housing;

a battery pack compartment in the housing interior adjacent to and between the plenum and one of the housing end panels;

a battery pack in the battery pack compartment and disposed in electrical communication with the fan motor;

a switch carried by the apparatus housing and disposed in electrical communication with the fan motor and the battery pack;

an elbow tubing connector rotatably carried by the housing cover panel of the apparatus housing and disposed in pneumatic communication with the plenum; and an elongated, bendable, flexible and resilient cooling tube disposed in pneumatic communication with the housing interior through the elbow tubing connector and having an air discharge end opposite the elbow tubing connector, the cooling tube parallel to a plane of the housing cover panel and capable of 360 degree rotation relative to the apparatus housing.

14. The firearm cooling apparatus of claim 13 wherein the battery pack comprises a pair of spaced-apart battery pack panels; a pair of electrical contacts on the battery pack panels, respectively, the electrical contacts disposed in electrical communication with the fan motor and the switch; and a plurality of batteries extending between and in electrical contact with the electrical contacts.

15. The firearm cooling apparatus of claim 14 wherein the battery pack panels of the battery pack are carried by the housing cover panel.

16. The firearm cooling apparatus of claim 13 wherein the battery pack compartment is disposed in pneumatic communication with the plenum.

* * * * *